US006168537B1

(12) United States Patent
Ezawa

(10) Patent No.: US 6,168,537 B1
(45) Date of Patent: Jan. 2, 2001

(54) GOLF CLUB HEAD

(75) Inventor: Hiroyuki Ezawa, Akishima (JP)

(73) Assignee: Golf Planning Co., Ltd., Akishima (JP)

( * ) Notice: Under 35 U.S.C. 154(b), the term of this patent shall be extended for 0 days.

(21) Appl. No.: 09/246,728

(22) Filed: Feb. 9, 1999

(30) Foreign Application Priority Data

Dec. 17, 1998 (JP) ..... 10-358514

(51) Int. Cl.[7] ..... A63B 53/04
(52) U.S. Cl. ..... 473/327; 473/349
(58) Field of Search ..... 473/324, 327, 473/345, 346, 347, 348, 349, 350, 332, 333, 334, 335, 336, 337, 338, 339, 343, 282, 291, 256, 228; D21/733, 734, 735

(56) References Cited

U.S. PATENT DOCUMENTS 4,900,029 * 2/1990 Sinclair .
5,193,810 * 3/1993 Antonious .
5,271,620 * 12/1993 Moriguchi .
5,465,970 11/1995 Adams et al. .
5,505,448 * 4/1996 Park .
5,944,620 * 8/1999 Elmer .

* cited by examiner

*Primary Examiner*—Sebastiano Passaniti

(57) ABSTRACT

A golf club head 10 includes a crown portion 11, a face portion 12, a side portion 13 a back face portion 14, and a neck portion 15. The crown portion 11 has a protruded portion in which a maximum point P of a curved contour of a central cross section (X—X line) of the crown portion is positioned rearwardly of the center I of the golf club head, and a cut-away portion obtained by obliquely cutting off the rear peripheral portion thereof. A volume V2 of a back-face-portion-side portion of the golf club head, which is positioned rearwardly of the head center I, is greater than a volume V2 of a face-portion-side portion of the golf club head, which is positioned in front of the head center I. On the curved contour of a central cross section of the crown portion 11, a relationship AB<CD is established where AB denotes a height between a leading edge of the golf club head front portion and the top edge A of the face portion, and CD denotes a height between an upper edge C of the cutaway portion and the intersecting point D at which the perpendicular drawn from the upper edge C intersects the back face portion.

12 Claims, 1 Drawing Sheet

GOLF CLUB HEAD

BACKGROUND OF THE INVENTION

1. Field of the Invention

The present invention relates to a golf club head which is preferably applicable to a wood or metal wood type golf club, etc.

2. Description of the Related Art

Conventionally, a "low centroid golf club", in which a centroid of a golf club head is positioned at a relatively lower place of the golf club head, has been known. In such a conventional low centroid golf club, a large proportion of the weight of the golf club is provided at the sole side of the golf club so that a loft at the time of impact (i.e., dynamic loft) is increased, whereby the ball hit by the golf club readily rises higher.

However, in the conventional low centroid golf club head, the low centroid is realized by providing a large amount of a metal having a large specific gravity, such as tungsten, copper, etc., at the sole side of the golf club, so that manufacturing cost is unfavorably increased.

SUMMARY OF THE INVENTION

It is therefore an object of the present invention to provide a golf club head which can increase the distance of the ball hit by the golf club head and reduce the cost for manufacturing the golf club head.

In order to achieve the above object, a first aspect of the present invention provides a golf club head including: a face portion; a back face portion; and a crown portion having a protruded portion in which a maximum point of a curved contour of a central cross section of the crown portion is positioned in the rear of the center of the golf club head.

A second aspect of the present invention provides a golf club head having a constitution according to the first aspect of the invention, wherein a volume of a back-face-side portion of the golf club head, which is positioned in the rear of the center of the golf club head, is greater than a volume of a face-portion-side portion of the golf club head, which is positioned in front of the center of the golf club head.

A third aspect of the present invention provides a golf club head having a constitution according to the first aspect of the present invention, wherein the crown portion has a cut-away portion obtained by obliquely cutting off the rear peripheral portion thereof.

A fourth aspect of the present invention provides a golf club head having a constitution according to the first aspect of the present invention, wherein, on a curved contour of a central cross section of the crown portion, a relationship AB<CD is established where AB denotes a height between the leading edge B of the front portion and the top edge A of the face portion, and CD denotes a height between an upper edge C of the cutaway portion and the intersecting point D at which the perpendicular drawn from the upper edge C intersects the back face portion.

A fifth aspect of the present invention provides a golf club head having a constitution according to the first aspect of the present invention, wherein the crown portion takes a stream line shape including a gentle tilt formed between the face portion and the maximum point and a steep tilt formed at a portion beyond the maximum point.

A sixth aspect of the present invention provides a golf club head having a constitution according to the first aspect of the present invention, wherein the face portion has a shallow face surface.

A seventh aspect of the present invention provides a golf club head having a constitution according to the first aspect of the present invention, wherein the face surface of the face portion is made of a material having a high coefficient of rebound (hereinafter, material having a high coefficient of rebound will often referred to as "highly rebounding material").

An eighth aspect of the present invention provides a golf club head having a constitution according to a first aspect of the present invention, wherein a metallic material is press fitted at a portion positioned in the rear of the center of the golf club head.

BRIEF DESCRIPTION OF THE DRAWINGS

Other features, objects and advantages of the present invention will become apparent from the following description of the preferred embodiments with reference to the drawings in which like reference characters designate like or corresponding parts throughout several views, and in which.

DETAILED DESCRIPTION OF INVENTION

The present invention will be described in more detail by way of preferred embodiments with reference to the attached drawings.

Figure 1A:
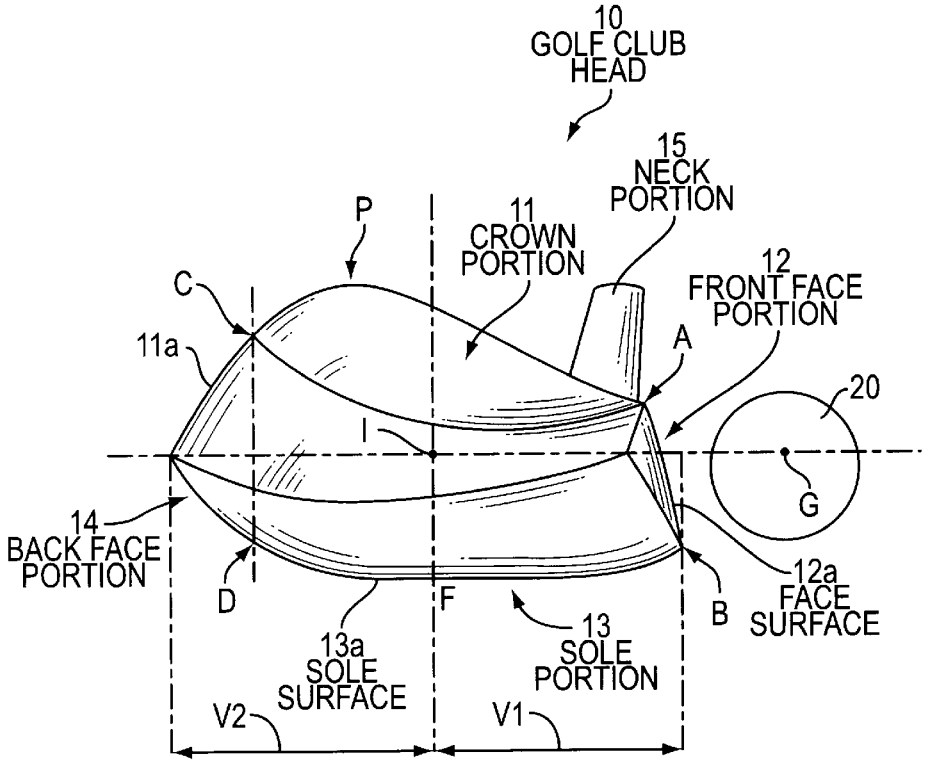
FIG. 1A is an elevational view of a golf club head according to the present invention.
Figure 1B:
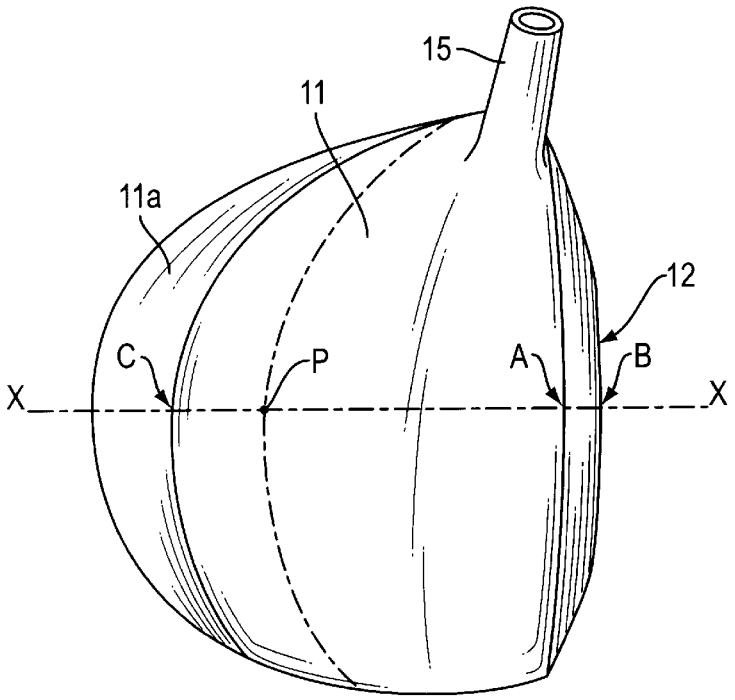
FIG. 1B is a plan view of the golf club head according to the present invention.

FIG. 1A is an elevational view of a golf club head 10 as an embodiment of a golf club head according to the present invention, and FIG. 1B is a plan view of the golf club head 10. As shown in FIGS. 1A and 1B, the golf club head 10 has a crown portion 11, a face portion 12, a sole portion 13, a back face portion 14, and a neck portion 15. In FIG. 1A, the reference numeral 20 shows a golf ball.

The crown portion 11 has a protruded portion in which the maximum point (i.e., the highest point) P of the curved contour of a central cross section (i.e., cross section taken along the X—X line shown in FIG. 1B) of the golf club head 10 is positioned rearwardly of the center I of the golf club head 10. The center of the golf club head will be often referred to as "head center" throughout this specification. Also, the crown portion 11 has a cut-away portion 11*a* formed by obliquely cutting off the rear peripheral portion of the crown portion 11.

Accordingly, in the crown portion 11, the volume V2 of the rearwardly portion thereof, i.e., the portion of the crown portion 11 positioned in rearwardly of the head center I is larger than the volume V1 of the front portion thereof, i.e., the portion of the crown portion 11 positioned in front of the head center I.

Further, on the curved contour of the central cross section of the crown portion in FIG. 1A, a relationship AB<CD is established where AB denotes the height between the leading edge B of the face portion and the top edge A of the face portion 12, and CD denotes the height between an upper edge C of the cut-away portion 11*a* and the intersecting point D at which the perpendicular drawn from the upper edge C intersects the back face portion 14. Furthermore, a metallic material, such as tungsten, copper, etc., is press fitted at the portion positioned rearwardly of the head center.

Thus, in the crown portion 11, the rearwardly portion thereof is made large and heavy, so that centroid depth can be determined to its maximum value. The term "centroid depth" as used herein refers to a distance (depth) between the face surface and the centroid of the golf club head. In the case where the centroid depth is determined to a great value, when the golf club is swung downward so that the golf club head is moved downward, the centrifugal force, which is generated by the swing and applied to the golf club head causes the centroid of the golf club head to move along the extended line of the grip of the golf club.

Accordingly, at the time of impact, the rear portion of the head goes slightly downward so that the face surface 12*a* turns upward, whereby the dynamic loft is increased. Consequently, the ball at the time of impact readily rises higher, so that the ball can take a trajectory powerful enough to defeat wind.

The crown portion 11 takes a stream line shape including a gentle tilt formed from the top edge A of the face portion 12 to the maxim point P and a steep tilt formed from the maximum point P to the upper edge C of the cut-away portion 11*a,* followed by the steep tilt of the cut-away portion 11*a.* Owing to this shape, when the golf club is swung, the air resistance can be markedly reduced so that the speed of the head is increased.

Since the crown portion 11 has the cut-away portion 11*a* having a tilt (inclined portion), the air resistance against the golf club can be controlled by making the angle of the tilt of the cut-away portion 11*a* proportional to the lie angle so that the player can swing the golf club along an accurate route to the impact zone (hitting point).

In the face portion 12, the face surface 12*a* is formed in a shallow manner i.e., generally short or shallow in relationship to the top edge and the bottom edge of the face surface surface 12*a.* Accordingly, the centroid of the golf club can be set to a lower position. Consequently, a lower centroid and a maximum centroid depth can be obtained at the same time.

Further, in the face portion 12, a highly rebounding material, such as titanium, maraging steel, etc., is employed for the face surface 12*a*, so that the initial velocity of the ball hit by the golf club can be increased.

Next, a process of manufacturing the golf club head 10 according to the preferred embodiment will be described below. Basically, the body of the golf club head 10 is made of a metal having a large specific gravity, such as stainless steel, etc., through casting or forging. The face surface 12*a* is made of a highly rebounding material, such as titanium, maraging steel, etc., and the face round thereof is fomed through press working.

As known from the above descriptions, according to the preferred embodiment, when realizing "lower centroid" or "shallowness" in the golf club head, the manufacturing cost can be reduced, compared with the case where a material having a large specific gravity, such as tungsten, and copper series material, is incorporated into the sole portion in a composite manner.

It should be noted that the single material can be processed through casting or forging, and that the composite material can be processed through casting, press working, press fitting (welding), and the like method.

As described above, the golf club head according to the preferred embodiment has the following marked advantages over conventional ones.

(1) In order to increase the centroid depth, in a conventional golf club head a, thin plate made of a highly rebounding material is attached on a face surface so as to reduce the weight of the face surface as much as possible.

In contrast, in order to increase the centroid depth, in the golf club head according to the preferred embodiment, the golf club head itself is formed in a shape apparently suitable for increasing the centroid depth. Accordingly, a great centroid depth can be obtained even with a material having a specific gravity greater than that of a usually employed material.

(2) Generally speaking, a fairway wood is so designed as to have a smaller head and a shorter golf club length compared with a driver (each of the terms "fairway wood" and "driver" referring to a type of a wood or metal wood golf club) for the following reasons. Specifically, such a smaller head is adopted because, when a lower centroid and a smaller head is realized in a fairway wood, the ball hit by the fairway wood readily rises higher. However, in this case, it is, generally speaking, difficult to successfully hit the ball. Therefore, in order to successfully hit the ball, it is necessary to swing the golf club skillfully. Further, it is necessary to increase the meet rate (i.e., a rate at which the ball is hit by a sweet spot of the golf club), and to enable the player to swing the golf club along a more stable locus. In view of these necessities, such a shorter golf club length is employed in a conventional golf club head.

In contrast, in the golf club head according to the preferred embodiment, a lower centroid and a great centroid depth can be obtained at the same time without reducing the size of the head. Accordingly, the golf club head according to the preferred embodiment can be applied to a fairway wood only by changing the loft angle of the golf club while maintaining the same size and shape of the golf club head. That is, the golf club head according to the preferred embodiment can be applied to a wood or metal wood type golf club of any number without changing the size of the golf club head. In other words, with respect to the golf club head according to the present embodiment, the borderline separating the concepts of "driver" and "fairway wood" is meaningless.

Further, according to the preferred embodiment, a constant length of a golf club can be realized only by changing the loft angle of the golf club regardless of the number of the golf club to which the preferred embodiment is applied. Accordingly, the player can hit the ball in the same swinging posture even when the number of the golf club he uses changes, so that he can perform a more stable shot.

Although the present invention has been described by way of the above mentioned preferred embodiments, the present invention can be varied and modified in various ways, and such variation and modification should be regarded as falling within the equivalent scope of the present invention.

For example, although, in the above descriptions, the golf club head of the present invention has been described by way of a wood or metal wood golf club, the golf club head of the present invention can be applied to a putter, etc.

As described above, the present invention has the following advantages.

(1) Since the area and volume of the rearwardly portion of the golf club head can be made larger than those of the front portion thereof, and the centroid depth can be set to its maximum value, the proceeding strength of the ball hit by the golf club is increased, so that the ball thus hit can take a trajectory powerful enough to defeat wind.

(2) Since, in addition to the constitution of determining the centroid depth to a great value, the face surface is formed in a shallow manner, the centroid can be determined to a lower position, so that a lower centroid and a maximum centroid depth can obtained at the same time.

(3) Further, since the contour of the golf club head is formed in a streamline shape, the air resistance at the time of swing is greatly reduced. Accordingly, in addition to the above-mentioned advantages (1) and (2), the present invention exhibits an advantage that the head speed can be increased. (4) Furthermore, the golf club head of the present invention is advantageous over a conventional golf club head in which the lower centroid is obtained by employing a material having a large specific gravity, such as tungsten, and copper series material in that the ball hit by the golf club head of the present invention flies at the same degree as in the case of the conventional golf club head while the manufacturing cost is markedly reduced.

What is claimed is:

1. A golf club head comprising:

a front face portion;

a back face portion; and a crown portion having a curved contour extending generally upwardly from adjacent said front face portion and toward an upwardly protruding portion that has a maximum upward point positioned rearwardly of a golf club head center located on a central axis in a direction between the front face portion and the back face portion.

2. The golf club head according to claim 1, wherein a volume of a first portion of the golf club head located rearwardly, which is positioned in the rear of the center) of the golf club head center is greater than a volume of a second portion of the golf club head located forwardly of the golf club head center.

3. The golf club head according to claim 2, wherein the volume of the first portion of the golf club head is formed greater than the volume of the second portion of the golf club head to set a maximum centroid depth value for the golf club.

4. The golf club head according to claim 1, wherein the crown portion has a rear peripheral cut-away portion between the upwardly extending protruding portion and the back face portion.

5. The golf club head according to claim 4, wherein the rear peripheral cut-away portion of the crown portion is set to minimize air resistance during swinging of the golf club.

6. The golf club head according to claim 1, wherein, on a curved contour of a central cross section of the crown portion, a relationship AB<CD is established with A denoting a top edge of the front face portion, B denoting a leading edge of the front face portion, and AB denoting a height between the leading edge B and the top edge A, and with C denoting an upper edge of the rear peripheral cut-away portions D denoting an intersecting point at which a perpendicular line drawn from the upper edge C intersects the back face portion and CD denoting a height between the upper edge C and the intersecting point D.

7. The golf club head according to claim 1, wherein the crown portion takes a stream line shape including a gentle tilt formed between the front face portion and the maximum upward point and a steep tilt between the maximum point and the back face portion.

8. The golf club head according to claim 1, wherein the front face portion has a shallow face surface in relationship to a top edge and a bottom edge of the face surface.

9. The golf club head according to claim 8, wherein the front face portion is formed with a shallow face surface to set a lower centroid position for the golf club.

10. The golf club head according to claim 1, wherein the face surface of the front face portion is made of a material exhibiting a high rebound.

11. The golf club head according to claim 1, wherein a metallic material is press fitted at a portion of the golf club head located rearwardly of the center of the golf club head.

12. A golf club head comprising:

a front face portion having a top edge and a bottom edge and a distance between said top and bottom edges;

a back face portion;

a sole portion; and a crown portion extending generally rearwardly from said top edge, said club head including a head center located on a central axis passing through the club head in a direction between the front face portion and the back face portion, said crown portion including a curved contour along a cross-section defined by said center axis, said curved contour including a gentle tilt formed from the front face portion generally upwardly toward a maximum point, and a steep tilt from the maximum point generally downwardly toward the back face portion, and said maximum point being located rearward of the head center.

* * * * *

UNITED STATES PATENT AND TRADEMARK OFFICE

CERTIFICATE OF CORRECTION

PATENT NO. : 6,168,537 B1
DATED : January 2, 2001
INVENTOR(S) : Hiroyuki Ezawa

It is certified that error appears in the above-identified patent and that said Letters Patent is hereby corrected as shown below:

Column 5,
Line 24, (claim 2), delete ", which is positioned in the rear of the center".

Column 6,
Line 3, (claim 6) change "portions" to --portion--,
Line 5, (claim 6) change "portion" to --portion,--.

Signed and Sealed this

Tenth Day of July, 2001

*Attest:*

Nicholas P. Godici

*Attesting Officer*

NICHOLAS P. GODICI
*Acting Director of the United States Patent and Trademark Office*